US008893777B1

(12) United States Patent
Garrett

(10) Patent No.: US 8,893,777 B1
(45) Date of Patent: Nov. 25, 2014

(54) LIQUID AERATION PLUNGER WITH CHEMICAL CHAMBER

(75) Inventor: Darren Garrett, Yukon, OK (US)

(73) Assignee: ANDDAR Products, LLC, Edmond, OK (US)

( * ) Notice: Subject to any disclaimer, the term of this patent is extended or adjusted under 35 U.S.C. 154(b) by 586 days.

(21) Appl. No.: 13/235,821

(22) Filed: Sep. 19, 2011

Related U.S. Application Data

(60) Provisional application No. 61/384,054, filed on Sep. 17, 2010, provisional application No. 61/491,784, filed on May 31, 2011.

(51) Int. Cl.
*E21B 27/00* (2006.01)
*F04B 47/12* (2006.01)

(52) U.S. Cl.
USPC ..... 166/169; 166/105; 166/166

(58) Field of Classification Search
CPC ..... E21B 43/121; F04B 47/12
USPC ..... 166/68, 90.1, 105, 165, 166, 169; 417/56, 57, 58, 59, 60, 904
See application file for complete search history.

(56) References Cited

U.S. PATENT DOCUMENTS 3,412,798 A 11/1968 Gregston
3,473,611 A * 10/1969 Gregston ..... 166/310
5,758,725 A 6/1998 Streetman
7,004,258 B2 2/2006 Farris
7,040,401 B1 5/2006 McCannon
7,117,947 B2 10/2006 Wilson
7,451,823 B2 11/2008 Wilson
7,513,301 B2 4/2009 Victor
7,556,100 B2 7/2009 Steiner
2008/0185141 A1 * 8/2008 Amies et al. ..... 166/105

* cited by examiner

*Primary Examiner* — David Bagnell
*Assistant Examiner* — Richard Alker
(74) *Attorney, Agent, or Firm* — Crowe & Dunlevy

(57) ABSTRACT

A chemical deployment plunger includes a reservoir body that has a top and a bottom and an internal chemical reservoir. The chemical reservoir includes one or more channels extending along the inside of the reservoir. The chemical deployment plunger includes a neck attached to the top of the reservoir body and the neck includes one or more ejection ports connected to the chemical reservoir. A plunger is movably connected to the bottom of the reservoir body and is configured for retraction and deployment from the reservoir body. The retraction of the plunger causes the treatment chemicals within the chemical reservoir to be expelled through the ejection ports. The plunger may include intake ports that allow the flow of fluid from below the plunger through the reservoir body and out the ejection ports. This permits the gradual release of treatment chemicals as fluids pass through the chemical deployment plunger.

3 Claims, 11 Drawing Sheets

LIQUID AERATION PLUNGER WITH CHEMICAL CHAMBER

RELATED APPLICATIONS

The present application claims the benefit of U.S. Patent Application No. 61/384,054, entitled Liquid Aeration Plunger with Chemical Chamber, filed Sep. 17, 2010 and U.S. Patent Application No. 61/491,784, entitled Apparatus for Chemical Injection in a Well, filed May 31, 2011, the disclosures of which are incorporated herein.

FIELD OF THE INVENTION

The present invention generally relates to the field of oil and gas well fluid production, and more particularly to a plunger lift apparatus for the lifting of formation liquids in a hydrocarbon well accompanied with or fitted with an apparatus for delivering well treatment chemicals.

BACKGROUND OF THE INVENTION

Wells are drilled to extract oil and gas from subterranean reservoirs. Oil and gas typically enter the well from the producing reservoir through perforations in the well casing. Initially, the reservoir pressure may be sufficient to overcome the force of gravity and force oil and gas out of the well. As the reservoir pressure decreases, however, fluids may accumulate at the bottom of the wellbore and it may become necessary to employ artificial lift systems to harvest the oil and gas. Examples of artificial lift systems include surface-mounted sucker rod pumps, electrical submersible pumps, plunger-lifts and gas-lift systems.

A plunger lift system works by cycling a well open and closed. During the open time, a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells that produce no gas are not candidates for plunger lift recovery systems.

As petroleum products are drained from subterranean formations, the reservoir energy gradually decreases. In some cases, the reduced reservoir pressure allows water to accumulate and "load" the well. Gas wells that are loaded with water tend to produce poorly in intermittent slug flow or cease to produce at all. Artificial lift and stimulation procedures are often used to increase production from a loaded well. Chemical additives are often used to unload, or "de-water" the well. In recent years, it has become popular to inject "foamer" solutions down a capillary string to aid in the unloading of water accumulated in the wellbore. As gas passes through the foamer and water mixture, bubbles form and lift the water from the well. Foamers, or "soaps," typically include a surfactant component that reduces the surface tension and fluid density of the water-well fluid mixture in the wellbore.

Current plunger lift systems, such as the plunger apparatus described in U.S. Pat. No. 7,513,301, only focus on the lifting of loaded liquids in wells. There is, therefore, a need for an apparatus and process for effectively and efficiently delivering foam-inducing chemicals or other well treatment chemicals to the loaded liquid to produce a foam thereby reducing the density of the liquid and subsequently increasing the functionality of the plunger.

SUMMARY OF THE INVENTION

In a preferred embodiment, the present invention includes a chemical deployment plunger for use in an oil or gas well.

The chemical deployment plunger includes a reservoir body that has a top and a bottom, and the reservoir body includes an internal chemical reservoir. The chemical reservoir includes one or more channels extending along the inside of the reservoir. The chemical deployment plunger includes a neck attached to the top of the reservoir body and the neck includes one or more ejection ports connected to the chemical reservoir.

A plunger is movably connected to the bottom of the reservoir body and is configured for retraction and deployment from the reservoir body. The plunger includes a base that is external to the reservoir body, a stem connected to the base that passes through the bottom of the reservoir body and a piston connected to the stem. The piston is internal to the reservoir body. The plunger also includes one or more intake ports extending through the base and stem, such that the one or more intake ports are placed into registry with the one or more channels extending along the inside of the reservoir when the plunger contracts within the reservoir body.

The plunger optionally includes a ball stop positioned within the stem that controls the movement of the plunger with respect to the reservoir body. The ball stop includes a spring channel extending through the stem in a transverse direction, a spring located within the spring channel, a ball secured to a first end of the spring and a set screw connected to the second end of the spring. The ball extends from the spring channel beyond the outer surface of the stem to cause interference as the stem attempts to pass through the bottom of the reservoir body. When the force exerted on the ball by the movement of the stem into the reservoir body exceeds the spring force, the ball retreats into the spring channel, thereby allowing the plunger to collapse within the reservoir body. The manipulation of the set screw adjusts the extent of force exerted by the spring onto the ball and thereby controls the response of the ball stop.

DETAILED DESCRIPTION OF PREFERRED EMBODIMENTS

Figure 1:
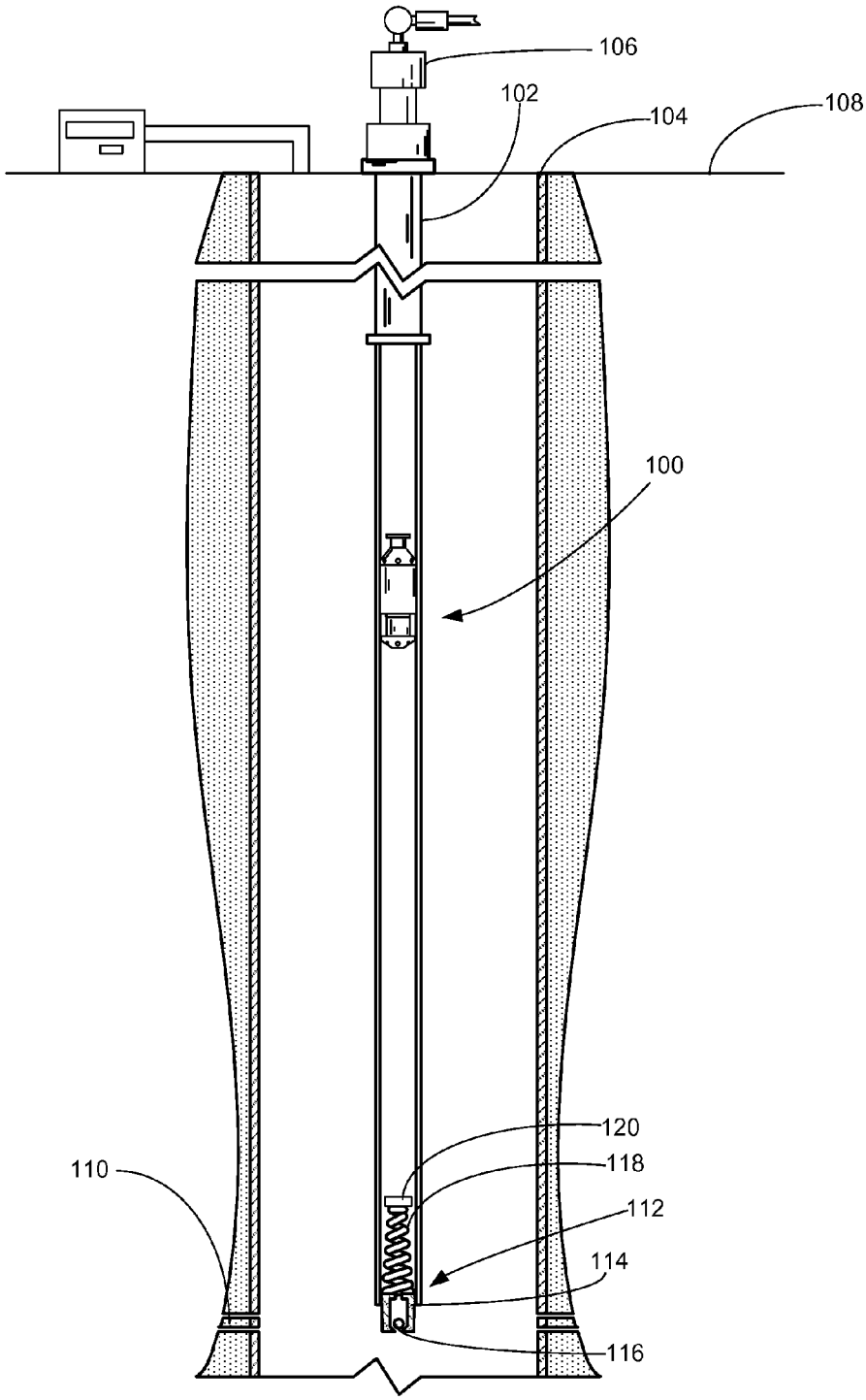
FIG. 1 is a cross sectional diagram of a plunger with chemical chamber constructed in accordance with a presently preferred embodiment being run in a tubing string.

In accordance with a preferred embodiment of the present invention, FIG. 1 shows an elevational view of a chemical deployment plunger 100 deployed within production tubing 102. The chemical deployment plunger 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects to a wellhead 106 located on a surface 108. The surface 108 may be the ground, a vehicle, a drilling rig or an offshore production platform. Petroleum products enter the wellbore 104 from a producing formation through perforations 110.

A standing valve 112 may be secured to the bottom of the production tubing 102. The standing valve 112 preferably includes a valve body 114 and a check ball 116. The standing valve 112 allows fluid and gas from the wellbore 104 to enter the production tubing 102, but prevents fluid from escaping from the production tubing 102. A bumper spring 118 and landing nipple 120 are preferably positioned above the standing valve 112 to more gradually reduce the velocity of the chemical deployment plunger 100 as it comes to rest within the production tubing 102.

Turning to FIGS. 2-6, shown therein are a close-up and cross sectional views, respectively, of the chemical deployment plunger 100 constructed in accordance with a first preferred embodiment. The chemical deployment plunger 100 is preferably manufactured from a durable, corrosion resistant material such as tool-grade steel or stainless steel. The chemical deployment plunger 100 generally includes a reservoir body 122, a plunger 124 and a neck 132. As described below, in various embodiments, the chemical deployment plunger 100 may not include the neck 132.

The reservoir body 122 is preferably configured as a bottle-shaped container that includes a chemical reservoir 126 and an open bottom 128 configured to receive the plunger 124. The chemical reservoir 126 is configured to carry a load of treatment chemicals 136. The chemical reservoir 126 is defined by the walls of the chemical deployment plunger 100, the top of the plunger 124 and the neck 132. The chemical reservoir 126 also includes a plurality of channels 130 that extend along the inside of the reservoir body 122.

The neck 132 preferably includes a fill plug 134, a plurality of ejection ports 138 and an API fishing collar 140. The neck 132 is preferably secured to the reservoir body 122 with roll pins 142, but it will be appreciated that other mechanisms for joining the neck 132 to the reservoir body 122 are contemplated within the scope of preferred embodiments. For example, it may be desirable to manufacture the reservoir body 122 and neck 132 for a threaded engagement. The bottom of the neck 132 includes a central passage 144 that is in fluid communication with the chemical reservoir 126. Although a single, large central passage 144 is presently preferred, alternate embodiments include the use of multiple, smaller passages the place the interior of the neck 132 in fluid communication with the chemical reservoir 126. The fill plug 134 is preferably configured for a threaded engagement with the neck 132. Removing the fill plug 134 permits the introduction of a selected quantity of treatment chemicals 136 into the internal chemical reservoir 126. Closing the fill plug 134 prevents the treatment chemicals 132 from escaping through the top of the chemical deployment plunger 100. In a particularly preferred embodiment, the treatment chemicals 136 are filled within the chemical reservoir 126 to a level just below the neck 132. The API collar 140 is preferably configured to be captured by a fishing tool in the event the chemical deployment plunger 100 is trapped within the production tubing 102.

The plunger 124 includes a base 146, a stem 148, a piston 150 and ball stop 152. The base 146 is preferably conically formed to improve the hydrodynamic characteristics of the chemical deployment plunger 100 as it falls through a column of liquid or gas in the production tubing 102. The base 146 is also adapted for impact when the chemical deployment plunger 100 comes to rest on the landing nipple 120. The stem 148 connects the base 146 to the piston 150. The stem 148 is sized to be only nominally smaller than the open bottom 128 at the bottom of the chemical reservoir 126. The piston 150 has a larger diameter than the stem 148 and is sized to fit in close tolerance with the non-grooved portion of interior wall of the chemical reservoir 126. Although not shown in FIGS. 2-6, the piston 150 may include rings or seals adjacent the wall of the chemical reservoir 126.

Figure 5:
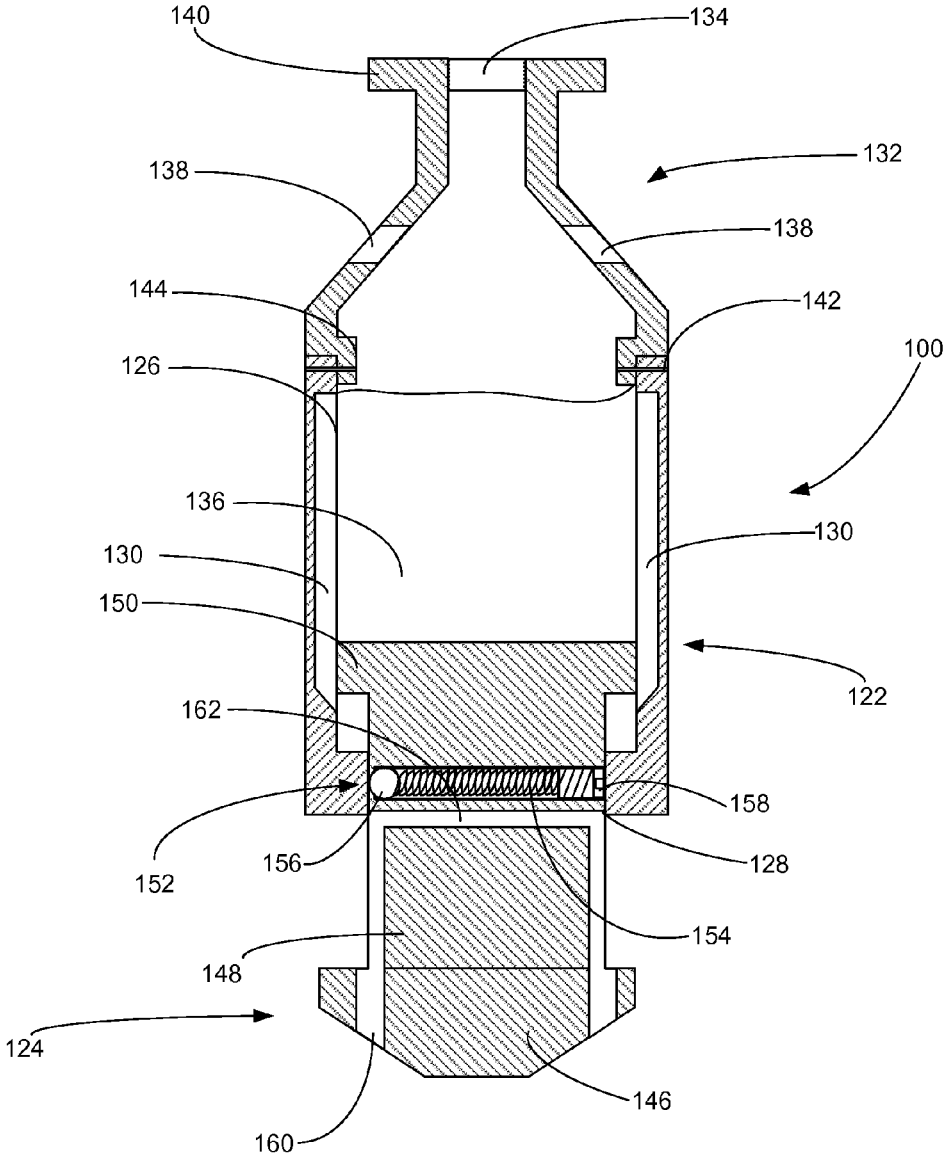
FIG. 5 is a partial cross-sectional view of the plunger of FIG. 2 in a partially deployed state.
Figure 6:
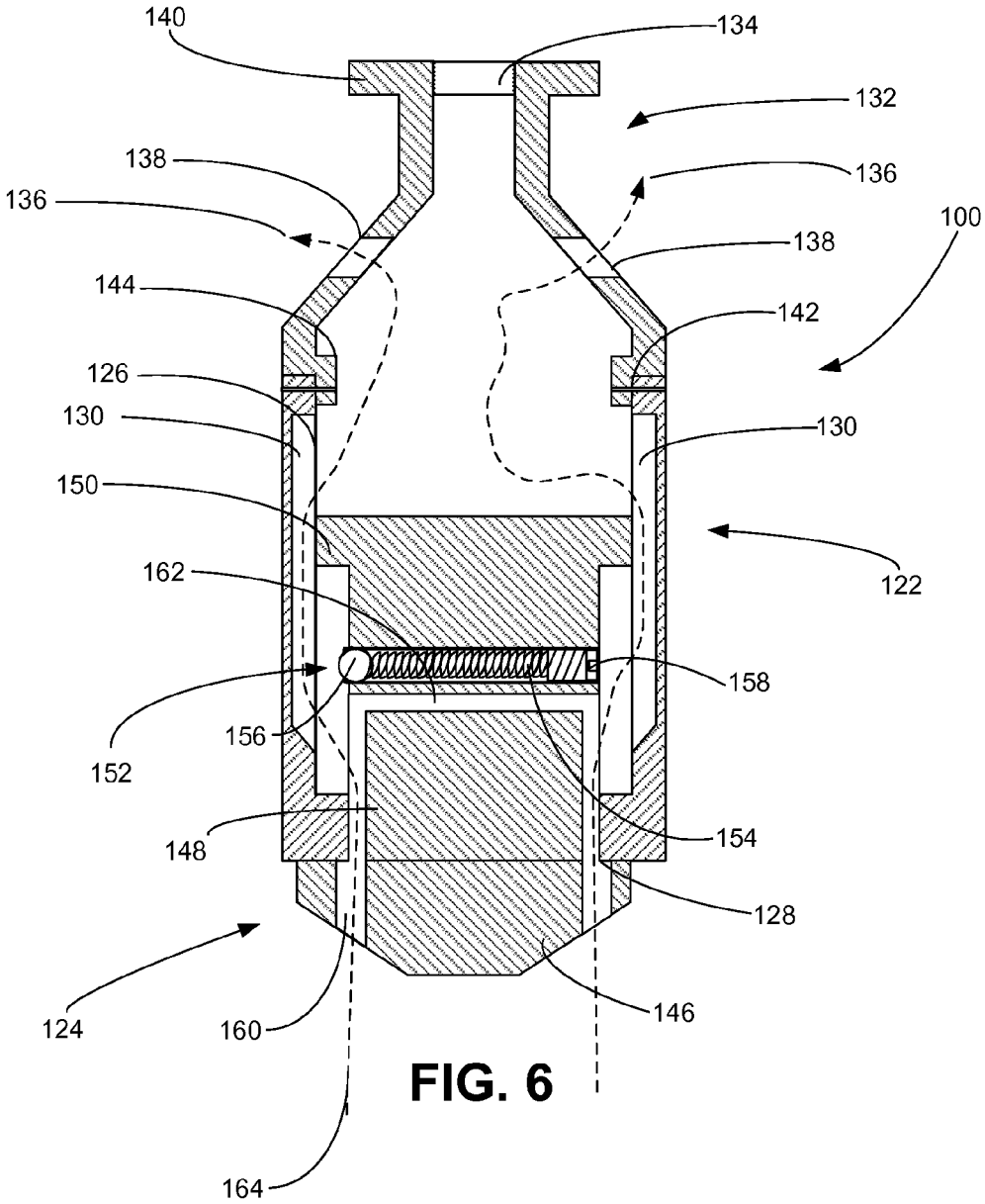
FIG. 6 is a partial cross-sectional view of the plunger of FIG. 2 in a fully deployed state.

The ball stop 152 is disposed on the stem 148 and includes a spring 154, a ball 156 and a set screw 158. The spring 154 biases the ball 156 in a position extending slightly beyond the surface of the stem 148. In this position, the ball 156 prevents the movement of the stem 148 through the open bottom 128 of the chemical reservoir 126 when no load is applied to the ball 156. As shown in FIG. 5, when a force is applied to the ball 156 through contact with the reservoir body 122 that exceeds the force applied by the spring 154, the ball 156 retreats, thereby allowing the plunger 124 to contract into the chemical reservoir 126.

The ball stop 152 prevents the plunger 124 from prematurely contracting as the chemical deployment plunger 100 moves through the production tubing 102. The force exerted by the spring 154 can be adjusted by turning the set screw 158 attached to the spring 154 that causes the effective length of the spring 154 to change. If a lighter response is required, the set screw 158 can be unscrewed to decrease the spring load placed on the ball 156.

In a first preferred embodiment, the ball stop 152 prevents the plunger 124 from contracting before the chemical deployment plunger 100 lands on the landing nipple 120 at the bottom of the production tubing 102. In this embodiment, the ball stop 152 prevents the plunger from contracting when the base 146 contacts debris or fluid in the production tubing 102. In an alternate preferred embodiment, the set screw 158 is adjusted to allow the ball 156 to retreat when the plunger 124 first contacts a fluid column in the production tubing 102. As explained below, this allows the chemical deployment plunger 100 to gradually release the treatment chemical 136 as it falls through the fluid column in the production tubing 102. This provides for a dispersed and delayed release of treatment chemicals 136 across a greater distance.

Continuing with the plunger 124, the base 146 and stem 148 include a plurality of intake ports 160. The intake ports 160 preferably extend through the base 146 and are exposed along the exterior surface of the stem 148. In this way, the intake ports 160 form grooves along the outside of the stem 148, but are joined by connecting internal passages 162.

Figure 2:
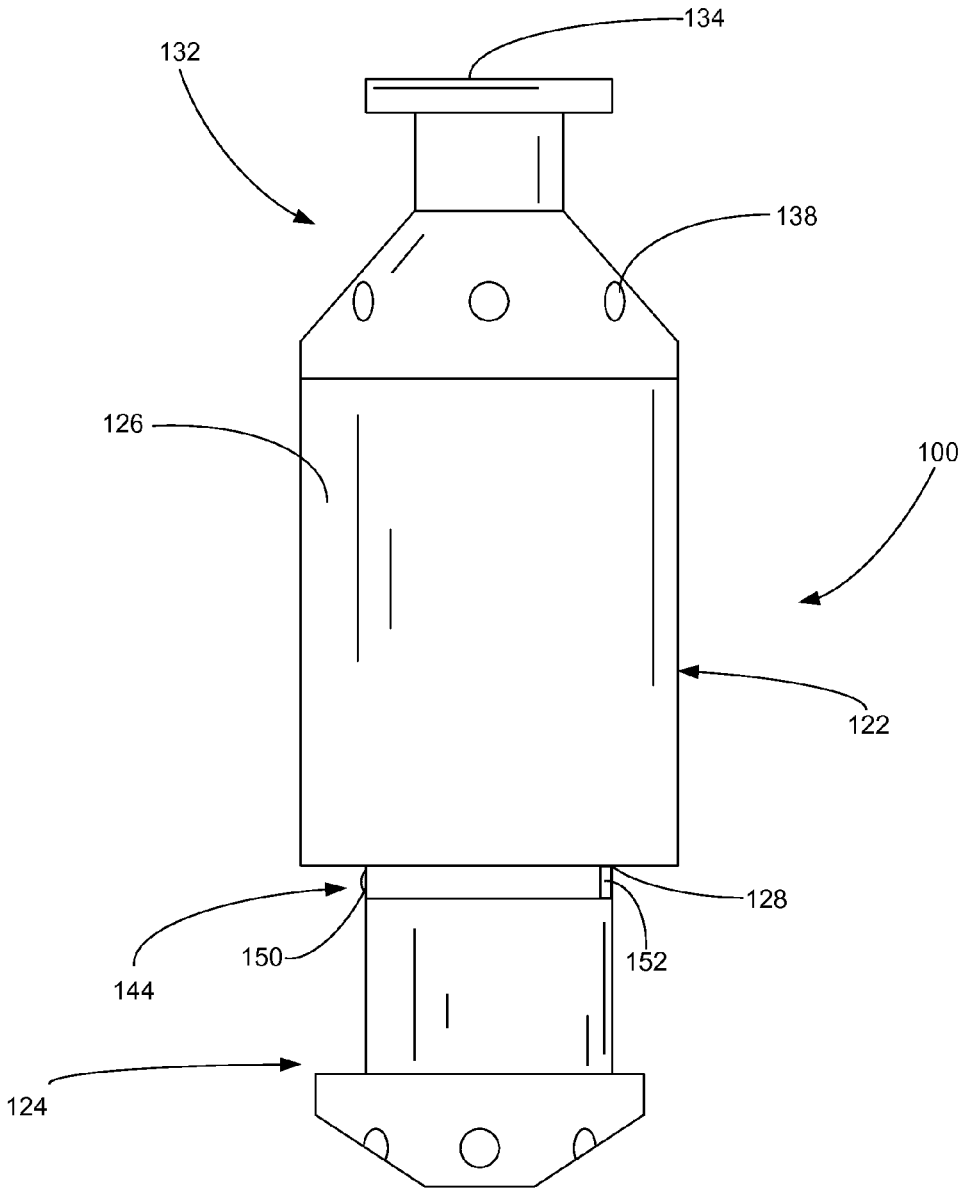
FIG. 2 is a close-up elevational view of a plunger constructed in accordance with a first preferred embodiment.
Figure 3:
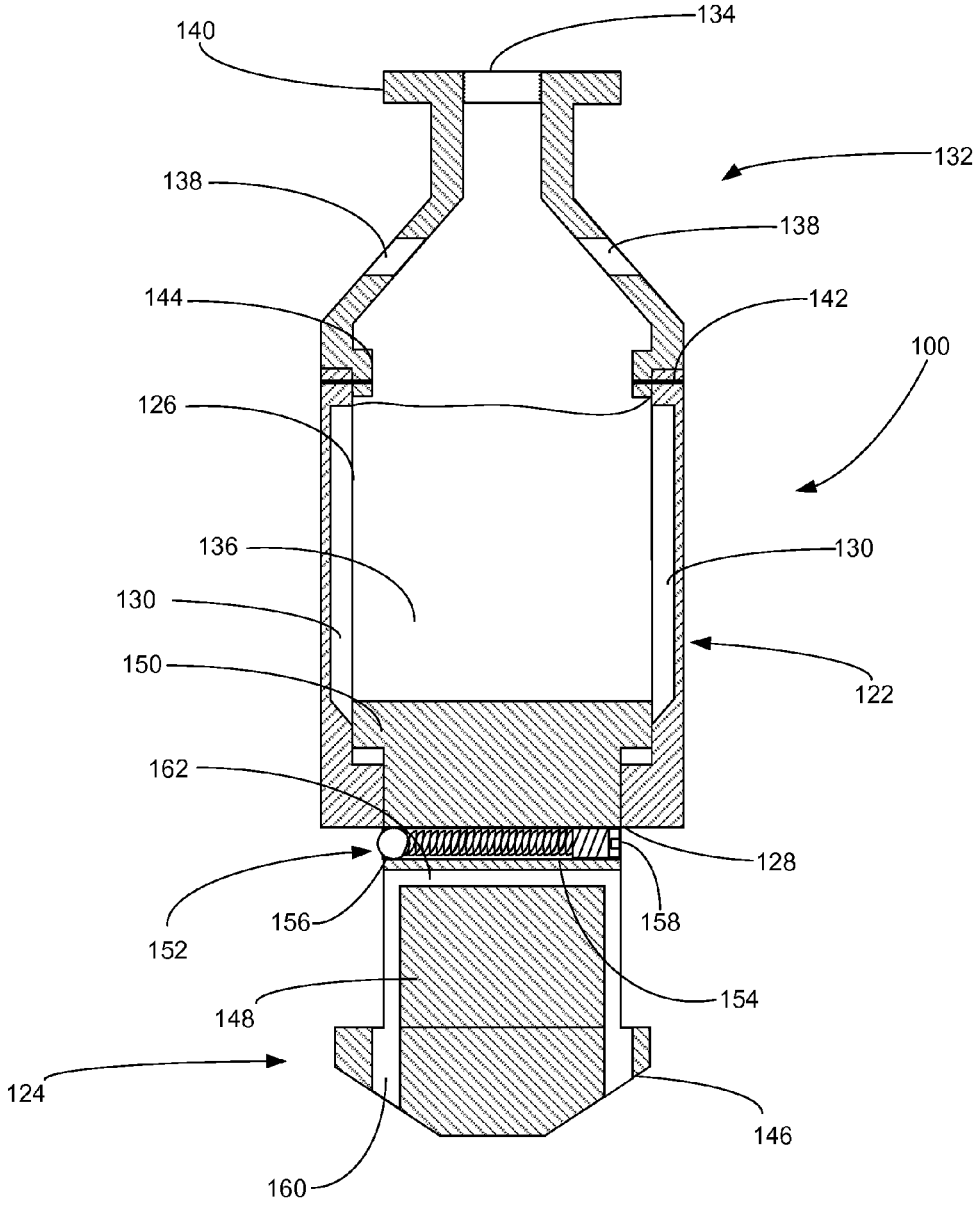
FIG. 3 is a partial cross-sectional view of the plunger of FIG. 2 in an open state.
Figure 4:
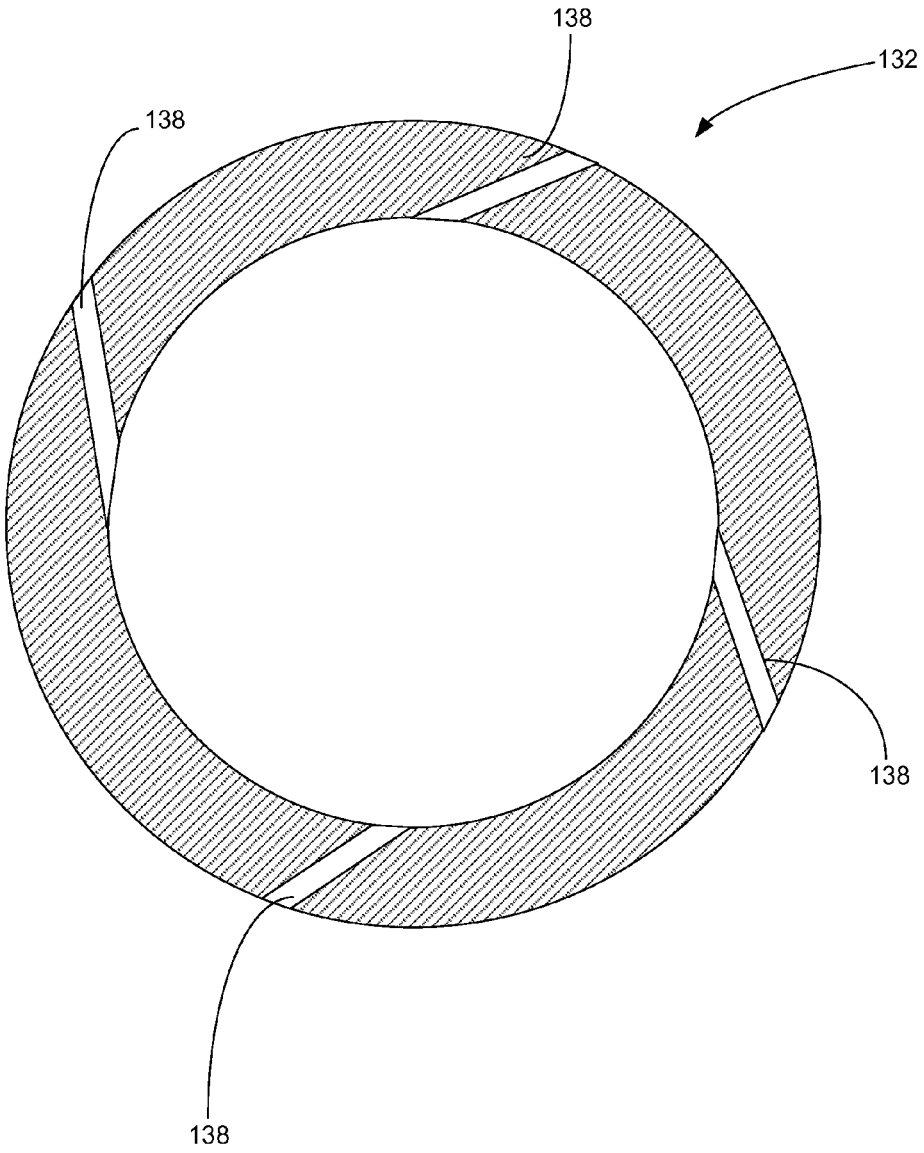
FIG. 4 is a top cross-sectional view of the neck of the plunger of FIG. 2 with angled ejection ports.

Use of the chemical deployment plunger 100 begins with the chemical deployment plunger 100 in an extended position shown in FIGS. 2-3. The fill plug 134 is removed and the selected treatment chemical 136 or chemicals 136 are introduced into the chemical reservoir 126 in a selected volume. The fill plug 134 is then replaced on the chemical deployment plunger 100. If an adjustable ball stop 152 is used, the set screw 158 should be adjusted to set the appropriate preload on the spring 154 and ball 156. The set screw 158 should be adjusted to select either a delayed release of treatment chemicals through a column of fluid in the production tubing 102 or a concentrated release of treatment chemicals at the bottom of the production tubing 102. The chemical deployment plunger 100 is then ready to be inserted into the production tubing 102 (as shown in FIG. 1).

In a presently preferred embodiment, the chemical deployment plunger 100 is inserted into the production tubing 102 using convention plunger lift equipment located on the surface 108. The equipment permits the selective release of the chemical deployment plunger 100 into the production tubing 102, where the chemical deployment plunger 100 falls through the production tubing 102. The ball stop 152 controls the contraction of the plunger 124 so that it either contracts upon contact with a column of fluid in the production tubing 102 to provide a delayed release or, alternatively, upon contact with the bottom of the production tubing 102 to provide a concentrated release of the treatment chemicals 136. Before the contraction of the plunger 124, the intake ports 160 are not connected to the chemical reservoir 126.

In yet another aspect of preferred embodiments, it will be noted that during the descent of the chemical deployment plunger 100 through fluid in the production tubing 102, some treatment chemicals 136 may be drawn out of the neck 132 through ejection ports 138 as a result of suction developed by the movement of the chemical deployment plunger 100 through fluid before the contraction of the plunger 124. The rate at which treatment chemicals 136 are drawn from chemical deployment plunger 100 during the descent can be moderated by adjusting the size of the ejection ports 138. Furthermore, as shown in top cross-sectional view of FIG. 4, the angle of the ejection ports 138 can be selected so that chemicals drawn out of the neck 132 induce a rotation in the chemical deployment plunger 100 as it descends. Inducing a rotation in the chemical deployment plunger 100 is believed to enhance the mixing of the treatment chemicals within the column of fluid in the production tubing 102.

As the chemical deployment plunger 100 falls through the production tubing 102, the chemical deployment plunger 100 may contact debris, fluid, packers and the landing nipple 120. If the force exerted on the ball stop 152 by the impact of the plunger 124 causes the ball 156 to retreat, the reservoir body 122 will continue to fall onto the plunger 124 (as depicted in FIG. 5). As the plunger 124 and reservoir body 122 collapse, the intake ports 160 register with the channels 130, thereby placing the chemical reservoir 126 in fluid communication with the wellbore below the chemical deployment plunger 100.

Gases and liquids 164 flow through the intake ports 160, through the base 146 and stem 148 and through the channels 130 into the chemical reservoir 126 where the gases and liquids 164 mix with the selected treatment chemicals. If the chemical deployment plunger 100 is configured for a delayed release, the gases and liquids will be forced into the intake ports 160 as the chemical deployment plunger 100 moves through the column. If the chemical deployment plunger 100 is configured for a more concentrated release, the treatment chemicals 136 are mixed with gases and liquids 164 entering the wellbore 104 through perforations 110 that pass through the standing valve 112.

The mixture of treatment chemicals and gases and liquids 164 are then expelled from the chemical deployment plunger 100 through the ejection ports 138. The flow of gases and liquids 164 is depicted by the dashed lines extending through the chemical deployment plunger 100. In this way, the chemical deployment plunger 100 provides for the progressive release of treatment chemicals 136 into the wellbore 104 above the chemical deployment plunger 100. By allowing gases and liquids from below the chemical deployment plunger 100 to pass through the chemical deployment plunger 100, the chemical deployment plunger 100 performs an aeration function that lowers the density of the fluid above the chemical deployment plunger 100.

The chemical deployment plunger 100 is carried out of the production tubing 102 by a pressure differential created across the chemical deployment plunger 100 in accordance with conventional gas lift plunger operation techniques. Notably, the chemical deployment plunger 100 is unlike most conventional plungers that provide for a solid interface between the fluid above and below the plunger. Although the use of the pass-through configuration of the chemical deployment plunger 100 does not provide the same solid interface, the optimized aeration and decrease in density above the chemical deployment plunger 100 nonetheless permits that retrieval of the chemical deployment plunger 100 according to conventional techniques.

Figure 7:
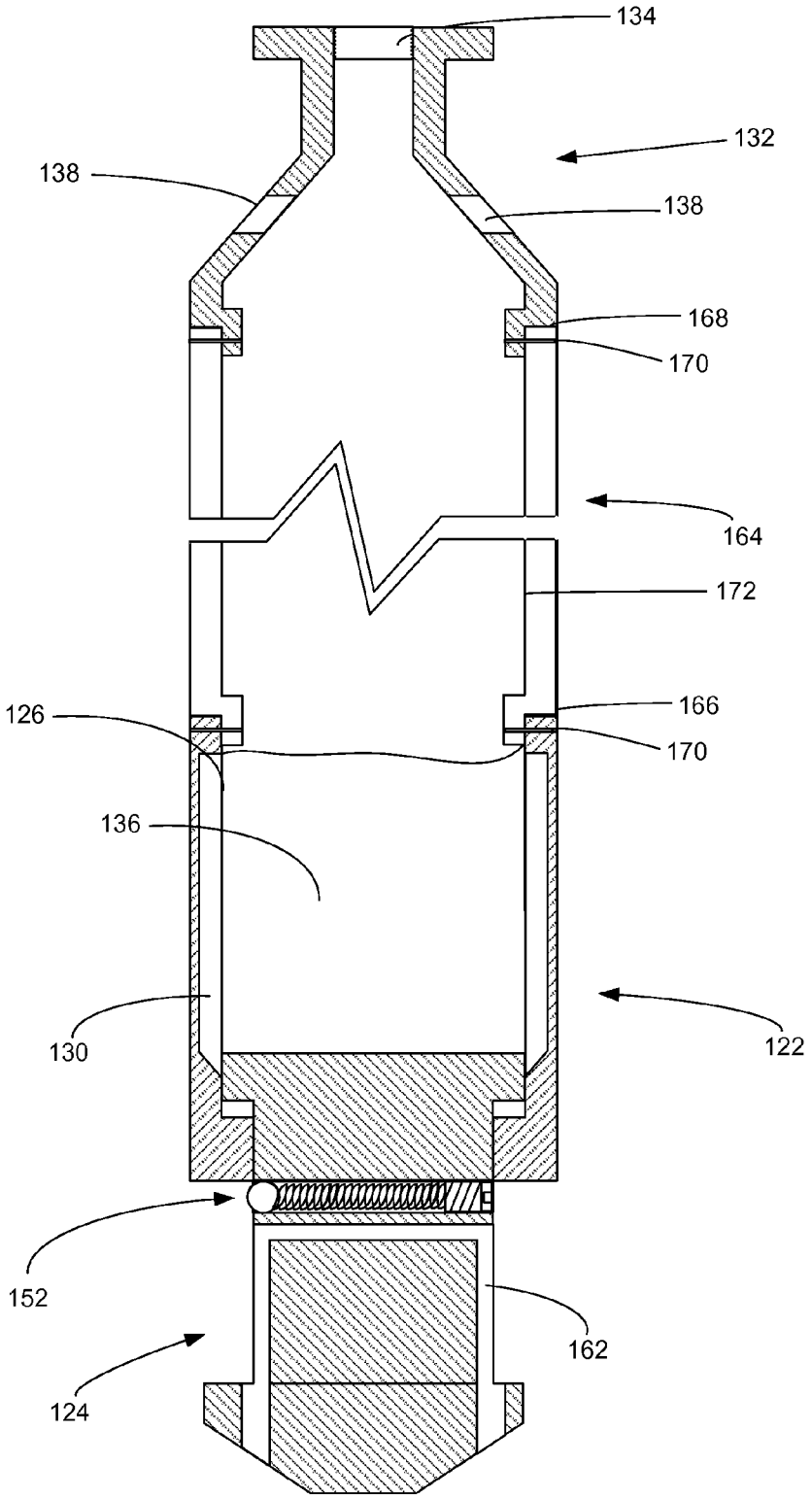
FIG. 7 is a partial cross-sectional view of the plunger of FIG. 2 combined with an existing plunger.

Turning now to FIG. 7, shown therein is a cross-sectional view of the chemical deployment plunger 100 connected to a third-party plunger 164. Although the chemical deployment plunger 100 can be used as a stand-alone device, the chemical deployment plunger 100 is also well adapted for connection with existing plungers 164. In an alternate preferred embodiment depicted in FIG. 6, the reservoir body 122 and plunger 124 are connected to the bottom 166 of an existing plunger 164. The neck 132 is connected to the top 168 of the plunger 164. In preferred embodiments, the neck 132 and reservoir body 122 are connected to the top 168 and bottom 166 of the plunger 164 with roll pins 170. It will be appreciated that the chemical deployment plunger 100 can be connected to existing plungers 164 through other connecting means, such as, for example, threaded or press-fit engagements.

The use of the chemical deployment plunger 100 with an existing plunger 164 is facilitated through the use of an existing plunger 164 that includes at least one fluid passage 172 extending through the plunger 164. The passage 172 connects the chemical reservoir 126 with the ejection ports 138 in the neck 132. The combination of the chemical deployment plunger 100 and an existing plunger 164 presents numerous advantageous benefits. For example, the connection of a paraffin plunger 164 with a chemical deployment plunger 100 that includes a paraffin treatment chemical 136 combines mechanical and chemical remediation efforts.

Turning to FIGS. 8-11, shown therein are a close-up and cross sectional views, respectively, of a second preferred embodiment of the chemical deployment plunger 200. The chemical injector 200 is preferably manufactured from a durable, corrosion resistant material such as stainless steel. The chemical deployment plunger 200 generally includes a reservoir body 202 and a plunger 204. The reservoir body 202 is preferably configured as a bottle-shaped container that includes a chemical reservoir 206, an open bottom 208 configured to receive the plunger 204, a plurality of ejection ports 210, a fishing neck 212 and a fill plug 214.

The chemical reservoir 206 is configured to carry a load of treatment chemicals 216. The chemical reservoir 206 is defined by the walls of the chemical deployment plunger 200, the fill plug 214 and the top of the plunger 204. The plurality of ejection ports 210 extend through the walls of the chemical deployment plunger 200 and provide a fluid path from the chemical reservoir 206 outside the chemical deployment plunger 200. In a particularly preferred embodiment, the chemical deployment plunger 200 includes a plurality of ejection ports 210 distributed around the cylindrical body of the chemical deployment plunger 200. To permit the rapid injection of chemicals from the chemical deployment plunger 200, the number and cross-sectional area of each of the ejection ports 210 should be selected to permit a sufficient release of treatment chemicals 136 upon contraction of the plunger 204 within the chemical reservoir 206. In a highly preferred embodiment, the total cross-sectional area of all of the ejection ports 210 is substantially the same as the cross-sectional area within the chemical reservoir 206.

The fill plug 214 is preferably configured for a threaded engagement with the fishing neck 208. Removing the fill plug 214 permits the introduction of a selected quantity of treatment chemicals 216 into the internal chemical reservoir 206. Closing the fill plug 214 prevents the treatment chemicals 132 from escaping through the top of the chemical deployment plunger 200. In a particularly preferred embodiment, the treatment chemicals 216 are filled within the chemical reservoir 206 to a level just below the ejection ports 210. The fishing neck 212 is preferably configured to be captured by a fishing tool in the event the chemical deployment plunger 200 is trapped within the production tubing 102.

The plunger 204 includes a base 218, a stem 220, a piston 222 and ball stop 224. The base 218 is preferably conically formed to improve the hydrodynamic characteristics of the chemical deployment plunger 200 as it falls through a column of liquid or gas in the production tubing 102. The base 218 is also adapted for impact when the chemical deployment plunger 200 comes to rest on the landing nipple 120. The stem 220 connects the base 218 to the piston 222. The stem 220 is sized to be only nominally smaller than the open bottom 208 at the bottom of the chemical reservoir 206. The piston 222 has a larger diameter than the stem 220 and is sized to fit in close tolerance with the interior wall of the chemical reservoir 206. Although not shown in FIGS. 8-9, the piston 222 may include rings or seals adjacent the wall of the chemical reservoir 206. As shown in FIG. 9, the base 218 is preferably held in connection with the stem 220 with a transversely mounted dowel 234. Due to the relative proximity between the base 218 and the production tubing 102, the dowel 234 is maintained in position and secures the base 218 to the stem 220.

Figure 10:
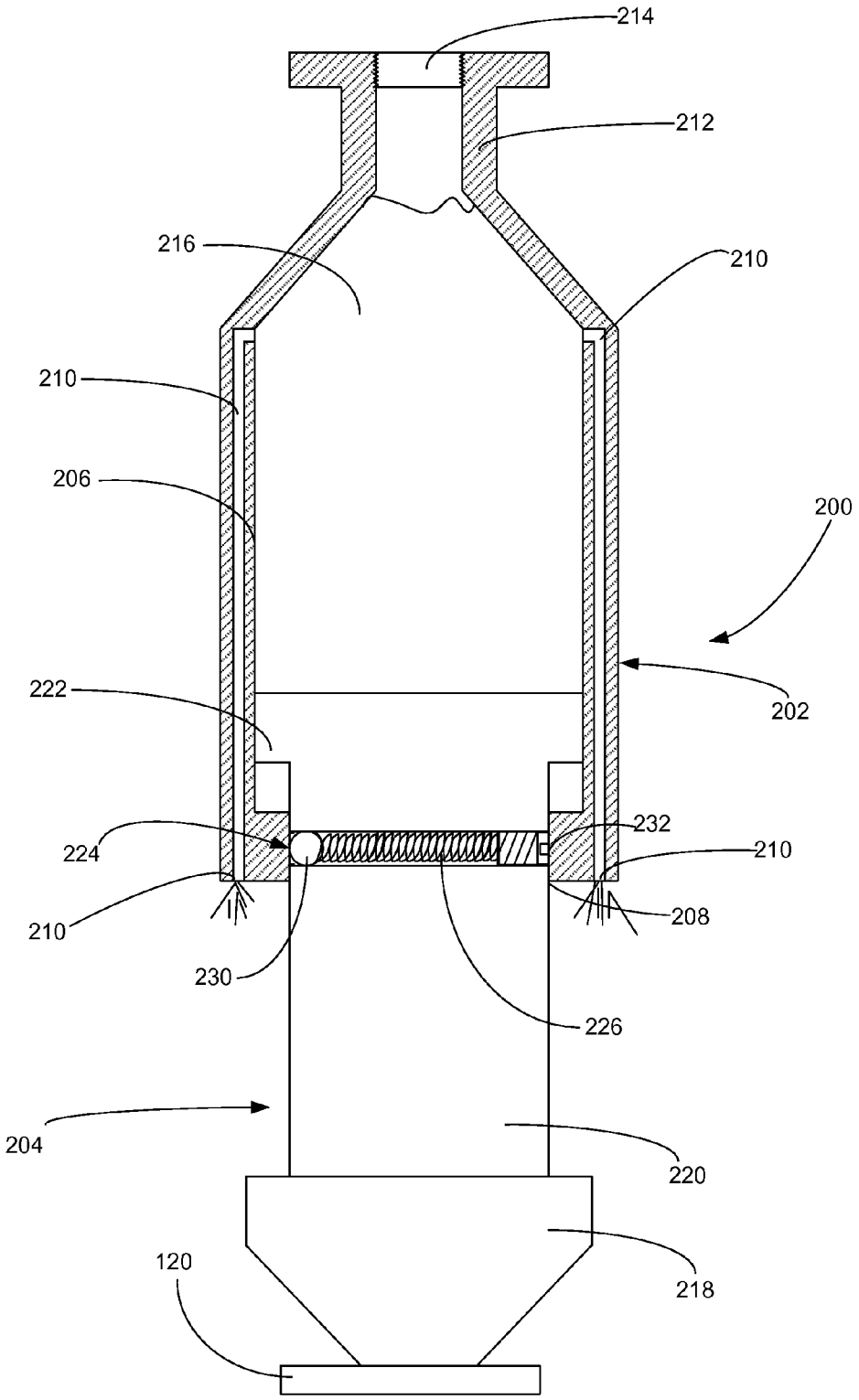
FIG. 10 is a partial cross-sectional view of the plunger of FIG. 8 in a partially deployed state.

The ball stop 224 is disposed on the stem 220 and includes a spring 226, a channel 228 and a ball 230. The spring 226 biases the ball 230 in a position extending slightly beyond the surface of the stem 220. In this position, the ball 230 prevents the movement of the stem 220 through the open bottom 208 of the chemical reservoir 206 when no load is applied to the ball 230. As shown in FIG. 10, when a force is applied to the ball 230 through contact with the reservoir body 202 that exceeds the force applied by the spring 226, the ball 230 retreats into the channel 228, thereby allowing the plunger 204 to contract into the chemical reservoir 206.

The ball stop 224 prevents the plunger 204 from prematurely contracting as the chemical deployment plunger 200 moves through the production tubing 102. Without the ball stop 224, the plunger 204 would likely contract when the base 218 contacts debris or fluid in the production tubing 102 before the chemical deployment plunger 200 reaches the bottom of the production tubing 102. In an alternate preferred embodiment, the force exerted by the spring 226 can be adjusted by turning a set screw 232 attached to the spring 226 that causes the effective length of the spring 226 to change. If a lighter response is required, the set screw 232 can be unscrewed to decrease the spring load placed on the ball 230.

Figure 8:
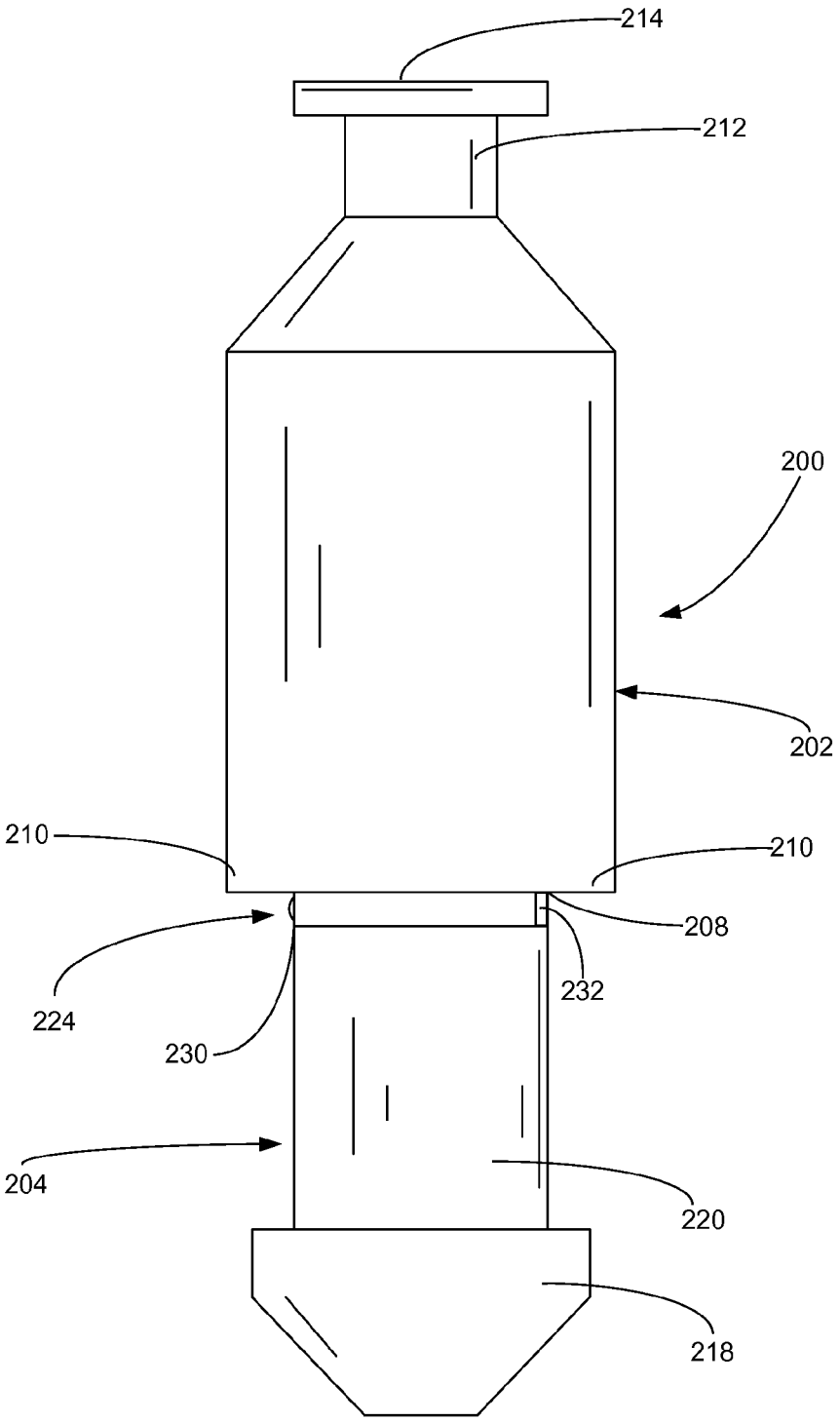
FIG. 8 is a close-up elevational view of a plunger constructed in accordance with a second preferred embodiment.
Figure 9:
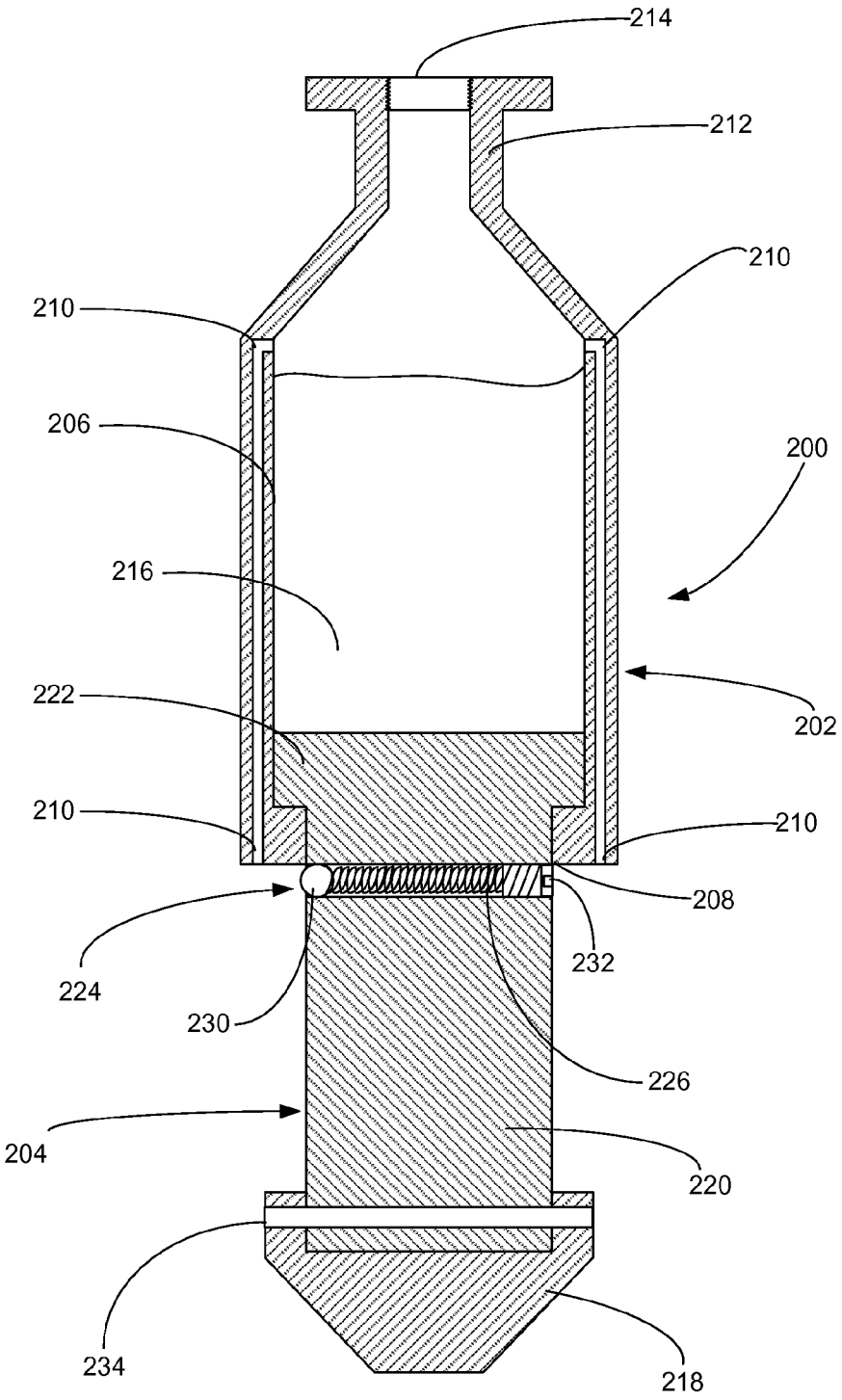
FIG. 9 is a partial cross-sectional view of the plunger of FIG. 8.

Use of the chemical deployment plunger 200 begins with the chemical deployment plunger 200 in an extended position shown in FIGS. 8-9. The fill plug 214 is removed and the selected treatment chemical 216 or chemicals 216 are introduced into the chemical reservoir 206 in a selected volume. The fill plug 214 is then replaced on the chemical deployment plunger 200. If an adjustable ball stop 224 is used, the set screw 232 should be adjusted to set the appropriate preload on the spring 226 and ball 230. The chemical deployment plunger 200 is then ready to be inserted into the production tubing 102 (as shown in FIG. 1).

In a presently preferred embodiment, the chemical deployment plunger 200 is inserted into the production tubing 102 using convention plunger lift equipment located on the surface 108. The equipment permits the selective release of the chemical deployment plunger 200 into the production tubing 102, where the chemical deployment plunger 200 falls through the production tubing 102. The ball stop 224 prevents the premature contraction of the plunger 204 in the event the chemical deployment plunger 200 contacts debris or fluid during its fall through the production tubing 102.

Figure 11:
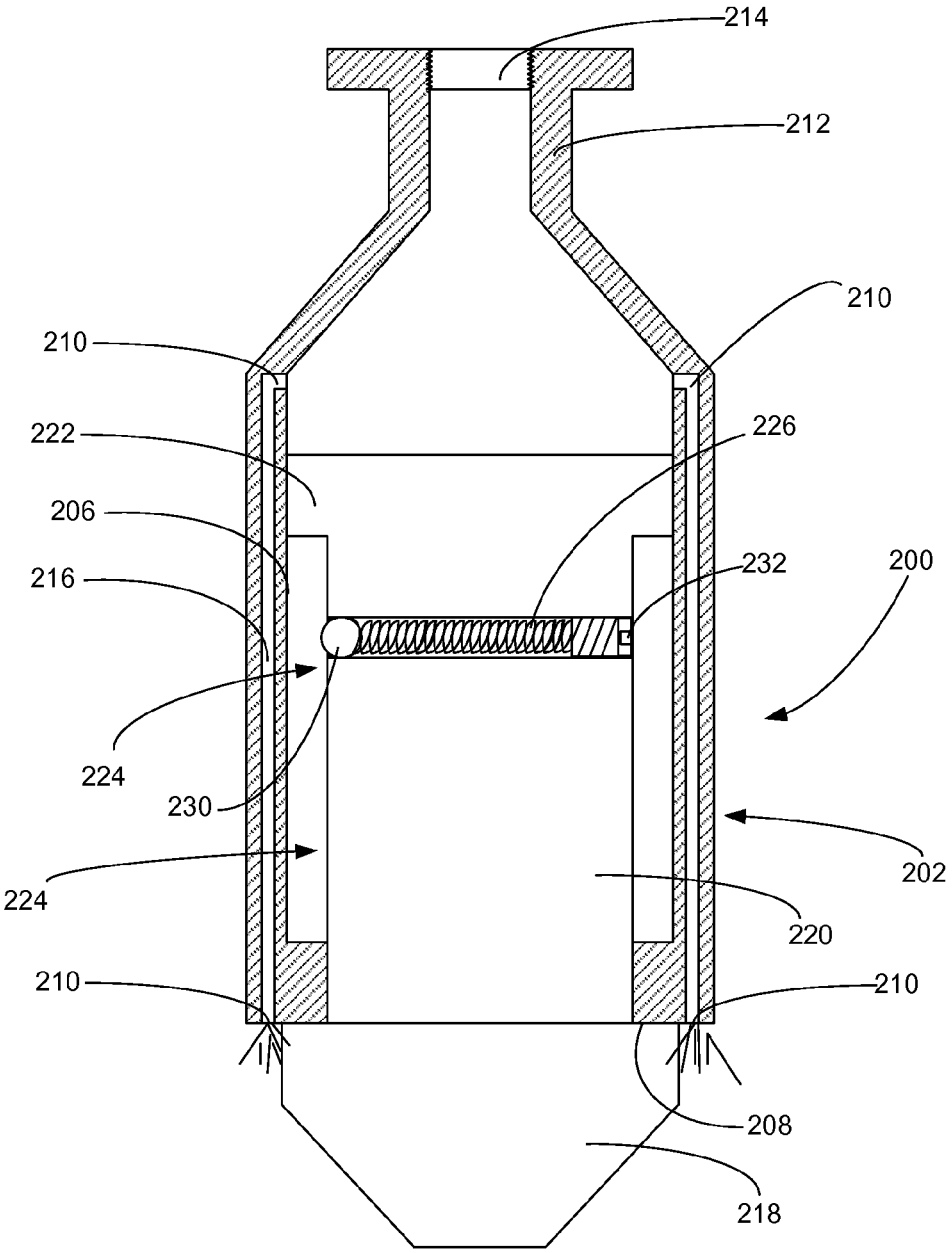
FIG. 11 is a partial cross-sectional view of the plunger of FIG. 8 in a fully deployed state.

When the chemical deployment plunger 200 reaches the bottom of the production tubing 102 and contacts the landing nipple 120, the force exerted on the ball stop 224 by the impact causes the ball 230 to retreat into channel 228, thereby allowing the reservoir body 202 to continue falling onto the plunger 204. As the plunger 204 and reservoir body 202 collapse, the piston 222 displaces the treatment chemicals 216 in the chemical reservoir 206. The treatment chemicals 216 are rapidly expelled into the wellbore 104 through the ejection ports 210. As shown in FIG. 11, the injection of treatment chemicals 216 from the chemical deployment plunger 200 is complete when the plunger 204 has completed its travel into the reservoir body 202 and the reservoir body is resting on the base 218 of the plunger 204. The chemical deployment plunger 200 is carried out of the production tubing 102 by pressurized fluids in accordance with conventional gas lift plunger operation techniques.

Even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein. It will be appreciated by those skilled in the art that the teachings of the present invention can be applied to other systems without departing from the scope and spirit of the present invention.

It is claimed:

1. A chemical deployment plunger for use in an oil or gas well, the chemical deployment plunger comprising:

a reservoir body having a top and a bottom, wherein the reservoir body comprises:

includes an internal chemical reservoir; and a plurality of ejection ports extending through the reservoir body through the bottom of the reservoir body;

a neck attached to the top of the reservoir body; and a plunger movably connected to the bottom of the reservoir body, wherein the plunger includes:

a base that is external to the reservoir body;

a stem connected to the base; wherein the stem passes through the bottom of the reservoir body;

a piston connected to the stem, wherein the piston is internal to the reservoir body; and a ball stop positioned within the stem, wherein the ball stop includes:

a spring channel extending through the stem in a transverse direction;

a spring located within the spring channel;

a ball secured to a first end of the spring, wherein the ball extends from the spring channel beyond the outer surface of the stem; and a set screw connected to the second end of the spring, wherein the manipulation of the set screw adjusts the extent of force exerted by the spring onto the ball.

2. The chemical deployment plunger of claim 1, wherein the base of the plunger is connected to the stem of the plunger with a transversely mounted pin.

3. The chemical deployment plunger of claim 1, wherein the plurality of ejection ports collectively have a total cross-sectional area that is approximately equal to the cross-sectional area of the internal chemical reservoir.

* * * * *